United States Patent [19]

Mochizuki et al.

[11] 4,178,983

[45] Dec. 18, 1979

[54] METHOD FOR MANUFACTURING STAINLESS STEEL DIE CAST PRODUCTS HAVING LOW MELTING POINT

[75] Inventors: Zenichi Mochizuki, Fuji; Yasuo Sugiura, Numazu; Nobuo Kashiwagi, Nagaizumimachi, all of Japan

[73] Assignee: Toshiba Kikai Kabushiki Kaisha, Tokyo, Japan

[21] Appl. No.: 945,886

[22] Filed: Sep. 26, 1978

[30] Foreign Application Priority Data

Sep. 29, 1977 [JP] Japan ..... 52/117174

[51] Int. Cl.[2] ..... B22D 27/10; C22C 38/42; C22C 38/44; C22C 38/54

[52] U.S. Cl. ..... 164/113; 75/125; 75/128 F; 75/128 A; 75/128 W

[58] Field of Search ..... 164/113, 119, 120, 303, 164/306, 312; 75/125, 128 F, 128 A, 128 W; 148/38

[56] References Cited

U.S. PATENT DOCUMENTS

| | | | |
|---|---|---|---|
| 3,615,880 | 10/1971 | Barto et al. | 164/113 X |
| 3,810,505 | 5/1974 | Cross | 164/113 |
| 3,900,316 | 8/1975 | Jones | 75/125 X |
| 3,912,503 | 10/1975 | Schumacher et al. | 75/125 |

FOREIGN PATENT DOCUMENTS

| | | | |
|---|---|---|---|
| 47-46646 | 11/1972 | Japan | 75/125 |
| 445522 | 6/1975 | U.S.S.R. | 164/120 |
| 460111 | 9/1975 | U.S.S.R. | 164/120 |

*Primary Examiner*—Robert D. Baldwin
*Assistant Examiner*—K. Y. Lin
*Attorney, Agent, or Firm*—Koda and Androlia

[57] ABSTRACT

In a method for manufacturing a stainless steel die cast product having low melting point, an alloy consisting of 0.01–0.1% by weight of carbon, 1.0–3.0% by weight of silicon, not more than 12% by weight (but excluding 3–7% by weight) of manganese, 8–25% by weight of nickel, 16–20% by weight of chromium, 1.5–2.5% by weight of copper, 0.?–0.7% by weight of boron, 0.5–2.0% by weight of molybdenum and the balance of iron is die-casted in a metal mold made of a tungsten alloy or a molybdenum alloy and maintained at a temperature of the metal mold of 250°–450° C. under conditions of a casting temperature higher than the liquid phase temperature of the molten alloy by 100°–150° C., an injection pressure of 200–500 kg/cm$^2$, and an injection plunger speed of 0.2–1.0 m/sec.

1 Claim, 4 Drawing Figures

METHOD FOR MANUFACTURING STAINLESS STEEL DIE CAST PRODUCTS HAVING LOW MELTING POINT

BACKGROUND OF THE INVENTION

This invention relates to a die cast method for manufacturing die cast products of austenite type stainless steel having low melting point.

Generally, stainless steels are classified in a range of from SCS 12 to SCS 23 as prescribed by the Japanese Industrial Standard (JIS) according to this compositions and used for die casting, but these stainless have a high melting point of over 1450° C., so that it is difficult to use these stainless steels for the die casting as they are. For this reason, stainless steels of low melting point have been developed wherein elements such as copper (Cu), manganese (Mn), silicon (Si), boron (B), niobium (Nb), phosphors (P), molybdenum (Mo), and the like are added to the stainless steels to lower this melting point. However, such stainless steel tends to form a boron compound, a phosphor compound and the like compounds which cause cracking of the cast products at elevated temperatures, when they solidify in a metal mold.

The reason for causing the cracking will be described hereunder in conjunction with FIGS. 1*a* and 1*b*.

Referring to FIGS. 1*a* and 1*b*, the molten metal of a stainless steel poured into in a metal mold A firstly solidifies near the contacting surface to the mold A. The solidified portions B grow as the temperature of the molten stainless steel lowers, and liquid portions C are surrounded by these solidified portions B as shown in FIG. 1*a*. When the solidification further proceeds, abnormal tension stress is generated on the surface of the cast product in the mold including a core, and cracks are formed at the boundary D between the liquid and the solidified portions. This is the most significant problem in the die casting.

SUMMARY OF THE INVENTION

Accordingly, an object of this invention is to provide a method for manufacturing stainless steel die cast products of low melting point which are hardly cracked while hot.

According to this invention, there is provided a method for manufacturing a stainless steel die cast product having low melting point in which an alloy consisting of 0.01–0.1% by weight of carbon, 1.0–3.0% by weight of silicon, 1–12% by weight (but excluding 3–7% by weight) of manganese, 8–25% by weight of nickel, 16–20% by weight of chrominum, 1.5–2.5% by weight of copper, 0.2–0.7% by weight of boron, 0.5–2.0% by weight of molybdenum and the balance of iron is die-casted in a metal mold made of a tungsten alloy or a molybdenum alloy and maintained at a temperature of the metal mold of 250°–450° C. under conditions of a casting temperature higher than the liquid phase temperature of the molten alloy by 100°–150° C., an injection pressure of 200–500 kg/cm$^2$, and an injection plunger speed of 0.2–1.0 m/sec.

DESCRIPTION OF THE PREFERRED EMBODIMENT

Figure 1A:
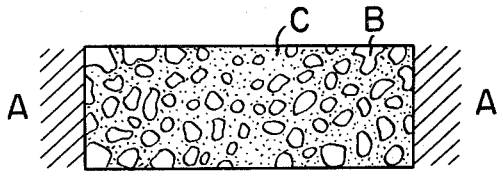
FIG. 1*a* shows a conditions of a molten stainless steel poured into a metal mold.
Figure 1B:
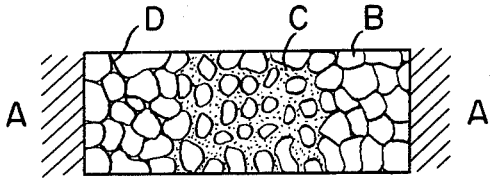
FIG. 1*b* shows a condition of the molten stainless steel at the time when the temperature of the steel lowers from that under the condition shown in FIG. 1*a;*

An alloy used for this invention consists of the following elements and the balance of iron.

(a) Manganese (Mn)

Manganese is usually included in a stainless steel as a deoxidation agent in an amount of 1–2% by weight and is used as an element for stabilizing austenization. Although the melting point of a stainless steel is lowered by 4° C. by additionally incorporating 1% by weight of manganese to the stainless steel, if the manganese is added by more than 12% by weight, the coefficient of heat expansion increases by more than 20% in comparison with that of a conventional stainless steel such as SUS 304 (SUS is a type of stainless steel clasified in accordance with the compositions by the provision of JIS) and complex oxides of silicon and manganese are formed. These complex oxides increase the tendency of forming cracks in the die cast product. In the case where nickel content is maintained at about 10% by weight and the content of the manganese is selected to be in a range of 3 to 7% by weight, shrinkage cavities expand thereby increasing the percentage of generated cracks in the cast product. Therefore, when it is required to add manganese to a stainless steel, it is necessary to select the manganese content to be in a range of from 7 to 12% by weight. However, regarding a stainless steel cast product such as an ornament or a trinket, it is required to suppress the manganese content below 3%, but above 1% because the manganese is easily oxidized on the surface of such product.

(b) Nickel (Ni)

Nickel is an element having an excellent corrosion resistance and is used for stabilizing austenization. The melting point of the stainless steel is lowered at a rate of 4° C. by adding thereto nickel in an amount of 1% by weight. Therefore, it is desired to add nickel to stainless steel by 8 through 25% by weight. The amount of nickel to be added should be determined in relation to the amount of manganese, and it is desirable that if nickel is added by more than 20%, the amount of manganese should be below 3%, and if the former is about 10%, the latter should be about 10%, by weight. With this proportion cast products having less tendency of cracking can be obtained without rising the melting point of the stainless steel.

(c) Chromium (Cr)

It is desirable that chromium is contained by about 16 through 20% by weight in stainless steel to improve the corrosion resistance. If chromium is contained in excess of these percentages, a ferite phase and/or δ phase are formed in the stainless steel die cast products, and if it is contained less than these percentages, the corrosion resistance is extremely lowered.

(d) Copper (Cu)

Copper itself does not severely affect the formation of the cracks in the stainless steel, but it should be added in an amount of at least 1% but below 2.5% by weight for compensating for the decrease in the corrosion resistance which is caused by the addition of a large amount of boron, manganese or the like. However, if the content of the copper exceeds 2.5%, segregation causing the cracking of a cast product will be induced.

(e) Boron (B)

Boron enters into the crystal lattice of steel and forms an intermetallic compounds such as $Fe_2B$ to lower the melting point, for example, by about 100° C. when 1% by weight of boron is added. However, the addition of the boron by more than 0.8% causes solidifying segregation of the stainless steel and facilitates the generation of the cracks at elevated temperatures. Therefore, it is desirable to add boron by an amount of from 0.2 to 0.7%, preferably in a range of 0.2–0.5% by weight.

(f) Molybdenum (Mo)

Molybdenum can be added in an amount of from 0.5 to 2% by weight to increase the strength of the solidified phase at elevated temperatures, but if it is added in excess of 2%, problems concerning the segregation or the increase in the solidifying temperature in the mold will be caused.

Although an improved crackless stainless steel having low melting point is proposed by incorporating these elements into conventional stainless steel by percentages mentioned above, since the resulting stainless steel contains a large quantity of various elements, the steel has a long concomitant time of liquid and solid phases. Therefore, it is impossible to completely eliminate the generation of the cracks only by suitably selecting the composition if the other conditions would not be considered. In order to shorten the liquid-solid concomitant time, it is necessary to rapidly cool the stainless steel and in order to perform the rapid cooling, it is required to suitably predetermine conditions as to the material for constructing a metal mold, the temperature of the metal mold, the casting temperature, the injection pressure and the speed of a plunger.

These conditions will be described in detail hereunder.

(a) Material of Metal Mold

Since the metal mold acts as a kind of a heat exchange, it is required to effectively absorb the heat of the poured molten stainless steel, so that a material having a large thermal conductivity must be used for the metal mold. Although a material for constructing a SKD-type (classification by JIS) metal mold generally has a thermal conductivity of 0.03–0.05 cal/cm. sec.°C., a mold made of molybdenum-tungsten alloy has a high thermal conductivity of 0.2–0.4 cal/cm. sec.°C. Where this molybdenum-tungsten alloy mold is used, cast products can be cooled at a speed ten times higher than that of a mold made of iron, so that the liquid-solid concomitant time is shortened and the hot cracking is eliminated.

(b) Temperature of Mold

In a case where molten metal of stainless steel is poured into a metal mold, if the temperature of the mold is low, the molten metal is immediately solidifies near the contacting surface to the metal mold, which results in a contractive cracking and if the temperature is high, the molten metal does not immediately solidify, which causes solidifying segregation and hot crackings. In view of these facts, the temperature of the metal mold should be maintained at about 250° through 450° C., preferably 400°±20° C., for obtaining excellent cast products.

(c) Casting Temperature

When casting molten metal, if the casting temperature is low, since the solid-liquid concomitant state is caused, injection pressure is not sufficiently applied to the whole molten metal and the molten metal is not fully injected in the cavity of the metal mold. Accordingly, it tends to form shrinkage cavities and to cause cracks in the cast product. On the other hand, if the casting temperature is high, the inside surface of the metal mold is superheated and the heat of the molten metal is not effectively reduced, so that in such a case, the cast product is easily cracked at high temperature. In view of these facts, the casting temperature which is higher than the temperature of the liquid phase by about 100°–200° C. is suitable for the die casting. Namely, since the melting point of stainless steel having low melting point is generally about 1260° C., the casting temperature of 1360°–1460° C., preferably 1400°–1450° C. is suitable for the die casting.

(d) Injection Pressure

Although a pressure for injecting molten metal into the cavity of a metal mold is influenced by the temperature of the molten metal, if the injection pressure is low at the temperature of the molten metal of 1400°–1450° C., the molten metal would not urged against the inside surface of the metal mold thus not rapidly cooled. This causes nonuniform solidification of the molten metal and cracks. However, if the injection pressure is considerably high, the injected molten metal engages tightly with the irregular surface of the mold, thereby increasing the resistance to the separation of the cast product from the mold thus causing the cracking of the product. In view of these facts, the injection pressure of 200–500 $kg/cm^2$, preferably 300–400 $kg/cm^2$ is suitable for the die casting.

(e) Injection Speed of Plunger

In a case where the molten metal is injected into the cavity of the metal mold by a plunger, if the molten metal is injected at a speed of below 0.2 m/sec., the molten metal would not thoroughly injected into the cavity due to irregular flow, thereby causing temperature difference throughout the injected molten metal and causing the hot crackings because of the insufficient injection pressure. On the other hand, if the injection speed of the plunger is higher than 1 m/sec., turbulent flow of the molten metal would be caused in the mold thus causing the cast product to be porous. Since the molten metal does not uniformly solidifies at the casting porosities, the crackings easily occure at this portion. Therefore, when die casting stainless steel having low melting point, it is desirable to inject the molten metal at a plunger speed of 0.2–1.0 m/sec., preferably 0.6±0.1 m/sec.

Accordingly, die cast products of stainless steel of low melting point can be obtained by instantly solidifying an alloy consisting of elements having compositions mentioned before under the casting conditions described above.

Figure 2:
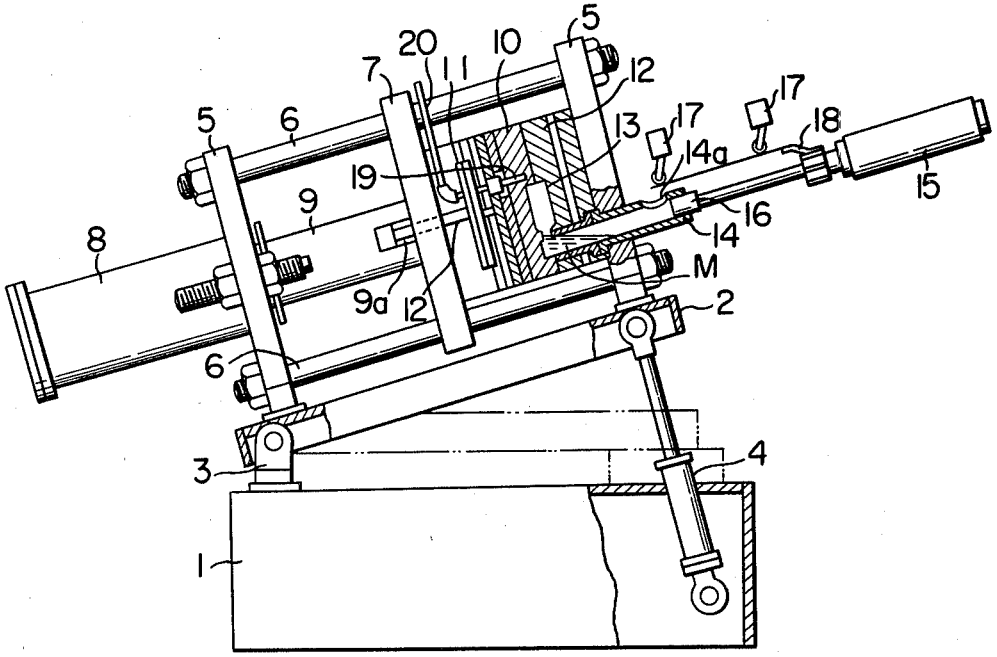
FIG. 2 shows a usual die cast machine for carring out a method of this invention.

FIG. 2 shows a conventional die cast machine suitable for carrying out the die cast method according to this invention. The die cast machine comprises a base 1, a supporting plate 2 pivotably attached to the base through pedestals 3, an oil pressure cylinder-piston assembly 4 secured to the base 1 and the plate 2 for raising one end of the supporting plate, a machine frame 5 mounted on the plate 2, a movable metal mold half 10 which is supported by a supporting base 7 secured to the frame 5 through slide bars 6, a stationary metal mold half 12, a sleeve 14 formed integrally with the stationary mold half 12, a plunger 16 slidably fitted in the sleeve and an injection cylinder 15 connected to the plunger 16.

In the use of this die cast machine, the molten metal of predetermined compositions and temperature is poured from a ladle into the sleeve 14 through an opening 14*a*. The molten metal M poured into the sleeve is injected into the cavity 13 formed between the movable and stationary mold halves 10 and 12 under pressure by means of the injection cylinder 15. The molten metal M in the cavity is held therein for a predetermined time and then the mobable mold half 10 is separated from the stationary mold half 12 by means of a piston-cylinder assembly 8, 9. Thus, the cast product is taken out from the mold half 12.

EXPERIMENT 1

1 kg of molten metal of stainless steel having low melting point and consisting of elements in various percentages, shown in Table 1 attached to the end of this specification, was die casted by the die cast machine shown in FIG. 2 under the following conditions.

Metal mold:tungsten alloy

Temperature of mold:350° C.

Casting temperature:temperature of liquid phase+150°=1410° C.

Injection pressure:300 kg/cm$^2$

Injection speed:0.6 m/sec.

Metal holding time in mold:5 sec.

Crack generating percentages of the cast products are shown in the right column in Table 1, and as is apparent from the Table 1, the cast products made of material Nos. 6, 7, 14 and 15, which consist of the elements having mixing percentages according to this invention, have less crack generation percentages than the other cast products. It will also be understood that the generation of the cracks is reduced by adding molybdenum and increased by adding manganese in an amount more than the prescribed amount, namely, 12% by weight.

Experiment 2

The material of No. 6 was casted under the following casting conditions.

Temperature of metal mold:200°, 300°, 400°, 500°, 600° C.

Casting temperature:1350°, 1450°, 1600° C.

Injection pressure:200, 500, or further, 100, 400, 600 kg/cm$^2$

Injection speed of plunger:0.15, 0.60, 1.20 m/sec.

The results of the die casting under these conditions are shown in Table 2 attached to the end of the specification. From Table 2, it will be understood that the cracks were generated at high percentages in the case where the casting conditions are out of the range defined by this invention even if the elements composing the stainless steel were added according to this invention. Further, in Table 2, considerably high crack generation percentages, i.e., 60, 50, 50%, are shown when a casting temperature of 1350° C. was used which is near the lower limit of this invention and out of the preferable casting temperature of 1400°–1450° C. Accordingly, it can be understood that good cast products can be obtained at a considerably high temperature.

From the results of the experiments 1 and 2, it will be apparent that die cast products having extremely excellent quality of stainless steel having low melting point and less cracks can be manufactured by incorporating specific elements to stainless steel in suitable percentages and under predetermined conditions according to this invention.

Figure 3:
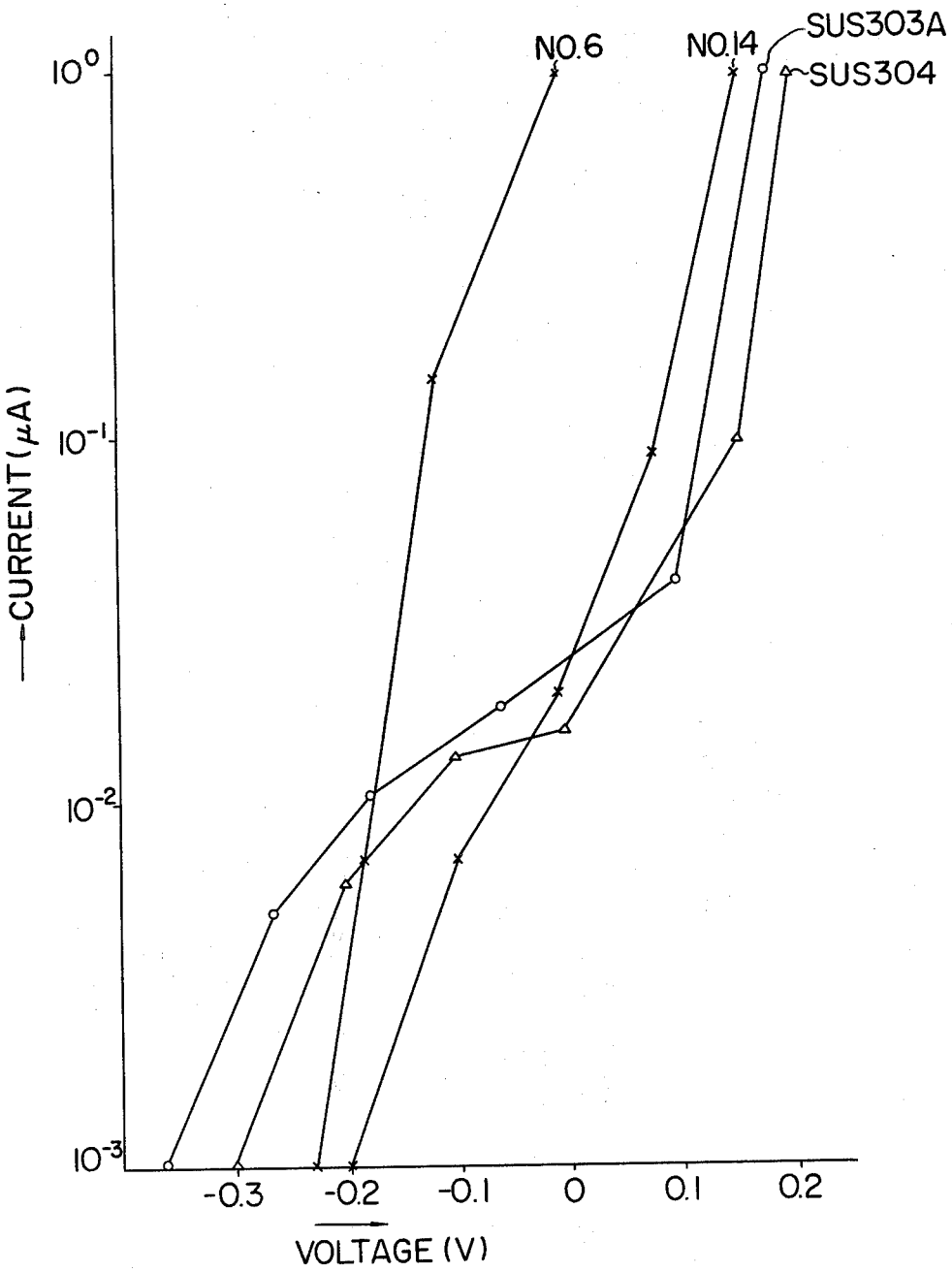
FIG. 3 is a graph showing results of an anode polarization test made on the conventional stainless steels and those manufactured by this invention.

Furthermore, an anode polarization test was carried out on the stainless steels Nos. 6 and 14 in Table 1 and conventional stainless steels of SUS 303A and SUS 304. The result is shown in the graph of FIG. 3 and shows that the stainless steels Nos. 6 and 14 have excellent corrosion resistance, and in another test it was confirmed that the stainless steels Nos. 6 and 14 have Vickers hardness of 180–200 Hv, which is substantially the same as that of SUS 304.

TABLE 1

CRACK GENERATION PERCENTAGE OF TEST MATERIALS

| COMPOSITION (%) TEST MATERIAL | C | S | Mn | Ni | Cr | Cu | B | Mo | CRACK GENERATION PERCENTAGE (%) |
|---|---|---|---|---|---|---|---|---|---|
| SUS 304 | 0.06 | 0.95 | 1.0 | 8.5 | 18.7 | — | — | — | 100 |
| No.1 | 0.06 | 2.10 | 17.0 | 8.5 | 16.5 | 2.10 | 0.40 | — | 100 |
| No.2 | 0.06 | 2.20 | 215.0 | 9.0 | 16.8 | 2.00 | 0.50 | — | 98 |
| No.3 | 0.07 | 2.30 | 13.0 | 10.0 | 17.0 | 2.00 | 0.40 | — | 75 |
| No.4 | 0.05 | 2.10 | 10.0 | 11.1 | 16.8 | 2.10 | 0.50 | — | 21 |
| No.5 | 0.06 | 1.80 | 9.5 | 10.8 | 16.6 | 1.60 | 0.30 | — | 20 |
| No.6 | 0.06 | 2.50 | 9.0 | 10.0 | 16.7 | 1.90 | 0.40 | 0.9 | 8 |
| No.7 | 0.05 | 2.30 | 10.0 | 11.0 | 17.0 | 1.80 | 0.50 | 1.2 | 6 |
| No.8 | 0.06 | 2.90 | 10.0 | 11.2 | 16.8 | 2.0 | 0.51 | 2.1 | 35 |
| No.9 | 0.05 | 2.20 | 15.0 | 22.0 | 17.8 | 1.65 | 0.41 | — | 75 |
| No. 10 | 0.05 | 2.00 | 12.1 | 23.0 | 16.9 | 2.10 | 0.35 | — | 31 |
| No. 11 | 0.07 | 2.50 | 11.5 | 20.0 | 17.2 | 1.85 | 0.41 | — | 15 |
| No. 12 | 0.06 | 2.15 | 1.5 | 21.5 | 18.0 | 2.00 | 0.50 | — | 15 |
| No. 13 | 0.07 | 2.10 | 3.0 | 22.8 | 18.5 | 1.90 | 0.38 | — | 21 |
| No. 14 | 0.05 | 2.00 | 1.7 | 25.0 | 17.3 | 1.75 | 0.42 | 0.85 | 10 |
| No. 15 | 0.07 | 1.96 | 1.2 | 21.0 | 18.0 | 1.99 | 0.30 | 1.30 | 11 |

TABLE 2

RELATIONSHIP BETWEEN CASTING CONDITIONS AND CRACK GENERATION PERCENTAGE

| Mold Temperature (°C.) | Injection Plunger Speed (m/sec.) | Injection Pressure (kg/cm²) | Casting Temperature (°C.) | Crack Generation Percentage (%) |
|---|---|---|---|---|
| | | | 1350 | 97 |
| | | 200 | 1450 | 92 |
| | 0.15 | | 1600 | 90 |
| | | | 1350 | 96 |
| | | 500 | 1450 | 90 |
| | | | 1600 | 90 |
| | | | 1350 | 96 |
| | | 200 | 1450 | 93 |
| 200 | 0.60 | | 1600 | 90 |
| | | | 1350 | 95 |
| | | 500 | 1450 | 90 |
| | | | 1600 | 90 |
| | | | 1350 | 96 |
| | | 200 | 1450 | 91 |
| | 1.20 | | 1600 | 88 |
| | | | 1350 | 97 |
| | | 500 | 1450 | 90 |
| | | | 1600 | 89 |
| | | | 1350 | 92 |
| 300 | 0.15 | 100 | 1450 | 93 |
| | | | 1600 | 93 |
| | | | 1350 | 90 |
| | | 200 | 1450 | 90 |
| | | | 1600 | 90 |
| | | | 1350 | 90 |
| | | 400 | 1450 | 87 |
| | 0.15 | | 1600 | 85 |
| | | | 1350 | 91 |
| | | 500 | 1450 | 87 |
| | | | 1600 | 87 |
| | | | 1350 | 92 |
| 300 | | 600 | 1450 | 87 |
| | | | 1600 | 89 |
| | | | 1350 | 93 |
| | | 100 | 1450 | 88 |
| | | | 1600 | 87 |
| | | | 1350 | 90 |
| | | 200 | 1450 | 50 |
| | 0.60 | | 1600 | 50 |
| | | | 1350 | 85 |
| | | 400 | 1450 | 30 |
| | | | 1600 | 40 |
| | | | 1350 | 87 |
| | | 500 | 1450 | 40 |
| | | | 1600 | 60 |
| | | | 1350 | 87 |
| | | 600 | 1450 | 60 |
| | | | 1600 | 75 |
| | | | 1350 | 90 |
| | | 100 | 1450 | 88 |
| | | | 1600 | 85 |
| | | | 1350 | 80 |
| | | 200 | 1450 | 70 |
| 300 | | | 1600 | 60 |
| | | | 1350 | 70 |
| | 1.20 | 400 | 1450 | 60 |
| | | | 1600 | 60 |
| | | | 1350 | 75 |
| | | 500 | 1450 | 60 |
| | | | 1600 | 65 |
| | | | 1350 | 80 |
| | | 600 | 1450 | 70 |
| | | | 1600 | 75 |
| | | | 1350 | 89 |
| | | 200 | 1450 | 85 |
| 400 | 0.15 | | 1600 | 85 |
| | | | 1350 | 90 |
| | | 500 | 1450 | 85 |
| | | | 1600 | 85 |
| | | | 1350 | 20 |
| | | 200 | 1450 | 10 |
| | | | 1600 | 30 |
| | 0.60 | | 1350 | 15 |
| | | 500 | 1450 | 30 |
| | | | 1600 | 30 |
| 400 | | | 1350 | 60 |
| | | 200 | 1450 | 50 |
| | 1.20 | | 1600 | 40 |

TABLE 2 -continued

RELATIONSHIP BETWEEN CASTING CONDITIONS AND CRACK GENERATION PERCENTAGE

| Mold Temperature (°C.) | Injection Plunger Speed (m/sec.) | Injection Pressure (kg/cm²) | Casting Temperature (°C.) | Crack Generation Percentage (%) |
|---|---|---|---|---|
| | | | 1350 | 55 |
| | | 500 | 1450 | 40 |
| | | | 1600 | 40 |
| | | | 1350 | 87 |
| | | 100 | 1450 | 85 |
| | | | 1600 | 85 |
| | | | 1350 | 85 |
| | | 200 | 1450 | 85 |
| 500 | 0.15 | | 1600 | 82 |
| | | | 1350 | 87 |
| | | 400 | 1450 | 87 |
| | | | 1600 | 80 |
| | | | 1350 | 85 |
| | | 500 | 1450 | 85 |
| | | | 1600 | 80 |
| | | | 1350 | 87 |
| | | 600 | 1450 | 84 |
| | | | 1600 | 80 |
| | | | 1350 | 84 |
| | | 100 | 1450 | 78 |
| | | | 1600 | 75 |
| | | | 1350 | 60 |
| | | 200 | 1450 | 20 |
| | | | 1600 | 25 |
| 500 | 0.60 | | 1350 | 50 |
| | | 400 | 1450 | 10 |
| | | | 1600 | 20 |
| | | | 1350 | 50 |
| | | 500 | 1450 | 20 |
| | | | 1600 | 25 |
| | | | 1350 | 50 |
| | | 600 | 1450 | 35 |
| | | | 1600 | 30 |
| | | | 1350 | 82 |
| | | 100 | 1450 | 85 |
| | | | 1600 | 80 |
| | 1.20 | | 1350 | 70 |
| | | 200 | 1450 | 40 |
| | | | 1600 | 55 |
| | | | 1350 | 60 |
| | | 400 | 1450 | 35 |
| | | | 1600 | 25 |
| | 1.20 | | 1350 | 70 |
| | | 500 | 1450 | 36 |
| | | | 1600 | 26 |
| | | | 1350 | 75 |
| | | 600 | 1450 | 30 |
| | | | 1600 | 25 |
| | | | 1350 | 85 |
| | | 200 | 1450 | 80 |
| | 0.15 | | 1600 | 80 |
| | | | 1350 | 85 |
| | | 500 | 1450 | 80 |
| | | | 1600 | 80 |
| 600 | | | 1350 | 55 |
| | | 200 | 1450 | 30 |
| | | | 1600 | 30 |
| | 0.80 | | 1350 | 45 |
| | | 500 | 1450 | 38 |
| | | | 1600 | 20 |
| | | | 1350 | 70 |
| | | 200 | 1450 | 30 |
| | 1.20 | | 1600 | 30 |
| | | | 1350 | 70 |
| 600 | 1.20 | 500 | 1450 | 25 |
| | | | 1600 | 23 |

We claim:

1. A method for manufacturing a stainless steel die cast product having low melting point comprising the step of die casting an alloy consisting of 0.01–0.1% by weight of carbon, 1.0–3.0% by weight of silicon, 1–12% by weight (but excluding 3–7% by weight) of manganese, 8–25% by weight of nickel, 16–20% by weight of chromium, 1.5–2.5% by weight of copper 0.2–0.7% by weight of boron, 0.5–2.0% by weight of molybdenum and the balance of iron into a metal mold made of a tungsten alloy or a molybdenum alloy and maintained at a temperature of 250°–450° C. under conditions of a casting temperature higher than the liquid phase temperature of the molten alloy by 100°–150° C., an injection pressure of 200–500 kg/cm², and an injection plunger speed of 0.2–1.0 m/sec.

* * * * *